US006695563B1

(12) United States Patent
Guzman

(10) Patent No.: US 6,695,563 B1
(45) Date of Patent: Feb. 24, 2004

(54) APPARATUS FOR INVERSION OF RACKED GLASSES

(76) Inventor: Jose Guzman, 3828-B Arizona St., San Diego, CA (US) 92104

( * ) Notice: Subject to any disclaimer, the term of this patent is extended or adjusted under 35 U.S.C. 154(b) by 0 days.

(21) Appl. No.: 10/371,063

(22) Filed: Feb. 20, 2003

Related U.S. Application Data

(62) Division of application No. 09/877,579, filed on Jun. 7, 2001.

(51) Int. Cl.[7] ..... B65B 21/02; B65B 69/00; B65F 3/02; B65G 65/04; B65G 65/34

(52) U.S. Cl. ..... 414/405; 414/404; 141/129; 141/171

(58) Field of Search ..... 141/129, 168, 141/171, 173, 174; 414/403, 404, 405, 414

(56) References Cited

U.S. PATENT DOCUMENTS

| | | | | |
|---|---|---|---|---|
| 2,447,281 A | | 8/1948 | Schneir | |
| 3,393,716 A | | 7/1968 | Olson | |
| 3,732,903 A | | 5/1973 | Oates | |
| 3,811,604 A | | 5/1974 | Perry | |
| 4,008,740 A | | 2/1977 | Chermack | |
| 4,270,584 A | | 6/1981 | Van Lieshout | |
| 4,411,295 A | | 10/1983 | Nutter | |
| 4,972,886 A | | 11/1990 | Bernstein | |
| 5,293,757 A | | 3/1994 | Nishio | |
| 5,360,309 A | * | 11/1994 | Ishiguro | 414/404 |

* cited by examiner

*Primary Examiner*—Timothy L. Maust
(74) *Attorney, Agent, or Firm*—Donn K. Harms

(57) ABSTRACT

A racked glass inverter which may be used alone or in combination with a processing system for preparing and filling beverage containers with ice and liquid. The beverage processing system simplifies the task of filling multiple glasses, cups or like containers with ice and a beverage, in a short time period, which is required with large crowds at restaurants and banquets. The system features three components including an ice tray, a glass inverter, and a glass filler, which in the best mode combine to the task of filling such beverage containers. The glass inverter is adapted to cooperatively engage with conventonal glass racks and allow two mated racks to be rotated thereby transferring the glasses from one to the other and inverting them in there position in the second rack.

11 Claims, 3 Drawing Sheets

APPARATUS FOR INVERSION OF RACKED GLASSES

This application is a Division of Ser. No. 09/877,579, filed Jun. 7, 2001.

FIELD OF THE INVENTION

The disclosed device relates to an apparatus and method for filling large quantities of beverage containers for consumption by diners. More particularly it relates to a device for inverting racked glasses use in restaurants and banquets where glasses, cups, or any similar form of containers must be filled with ice, and then a beverage. This is most commonly done at large dinners and banquets requiring the preparation of the water glasses prior to being distributed to customers. Currently, the glass filling process is accomplished by filling one glass at a time with ice and then water, which is very time consuming. One of the reasons for this slow process is the fact that when glasses are washed in racks, they are placed in an inverted position relative to the open tops of the dividers in the racks. Consequently they must be removed and flipped over prior to being filled. While there are some apparatus that attempt to speed this process, they are complicated, expensive and hard to maintain. In the food service industry, cleanliness, limiting waste and speed of delivery, and ease of installation and transport are of the highest priorities.

BACKGROUND OF THE INVENTION

In the food service industry with the many requirements involved in satisfying the customer, the filling of water glasses would seem to be a minor problem until one realizes it is a full time position for at least one person at large restaurants, and a congestion problem when more than one server is trying to do the same task at the same time at smaller establishments. In this industry it is fully understood that the main grouping of customers will arrive within a relatively short period of time, thereby providing only a limited preparation time especially with regard to a perishable item such as the ice in a water glass. In restaurants it is common practice to individually fill a quantity of water glasses some time in advance of their being served to the customers in order that the time consuming task be avoided during the peak customer period. The task of filling large numbers of water glasses entails the glass being removed from a washing rack in which they are conventionally stored and transported, inverted to place the open end upward, and hand held separately to be filled with ice and then fluid from a tap or a pitcher. Trays of filled glasses may sit for a considerable period prior to being served during which time the ice may melt and the drinking water return to room temperature, also being subject to dust and germ contamination.

With the advent of the new ice machines, the task of filling glasses was made somewhat easier in that ice is made in varying sizes and shapes, and kept at a uniform temperature whereby it will not solidify into larger solid pieces and not require breaking apart to use, and is easily handled in small amounts. In the past, the ice machines did not maintain a uniform temperature, especially being opened and closed often. The breaking up of the ice pieces was an added task to the filling of the glasses.

At the snack bars, sporting events, conventions, banquets, and other similar activities, it is frustrating to wait in line while the server fills one container at a time with ice, then a beverage. A problem with the multiple glass filling devices that are available is that they are very complicated, hard to maintain while others perform one procedure of the process adequately, and leave the other parts of the process to be accomplished manually. When some of these devices are filled with large quantities of ice to fill the glasses, the ice will solidify into one solid piece when not used quickly, requiring the pieces to be broken up manually.

Another problem arises with liquid disbursement when using conventional multiple filling manifold devices since when turned off, the disbursement manifolds do not drain evenly, and will produce an uneven filling of the glasses which are generally filled while multiple glasses are held in a rack. This uneven filling often requires the tipping of the very heavy rack and holding the glasses to equalize the amount of liquid within, limiting their usage mainly to the filling of water glasses where spillage does not involve product loss.

When using beverages in a multi-glass filling device, the task of cleaning the complicated mechanisms is also much too time consuming. In the food service industry, almost all equipment used in the serving of food and related products are constructed of stainless steel and must be kept very clean, which adds a great deal to their purchase costs. Some prior art attempts to address these issues but has not solved them.

U.S. Pat. No. 4,008,740 of Robert W. Chermack describes a dispensing apparatus for filling drinking containers. A dispensing apparatus for filling a plurality of drinking containers positioned in predetermined locations on a tray dispenses ice, water or both. The apparatus has a storage hopper for containing a supply of ice, the hopper having a discharge opening at the bottom which communicates with a gate for controlling the flow of the ice from the discharge opening. A plurality of generally upright chutes is positioned below the gate and extends from the gate to the receiving chamber near the base of the apparatus. In use, the tray and drinking containers are positioned in the chamber and receive the ice from the chutes, the outlet of each chute being positioned over one of the drinking containers. This apparatus described maintains a series of rollers to distribute the ice to the chutes, which if not refrigerated will let the ice solidify into larger pieces, requiring breaking up manually. Also, the turning of ice in this manner is used effectively in ice-cream machines to intensify the localized cooling, causing additional problems. Furthermore, this apparatus employs a slanted bottom to equalize the overflow of the water in the glasses produced by uneven dispensing, insuring that this apparatus would not be effectively useable in dispensing any other liquid beverage.

U.S. Pat. No. 4,270,584 of Marinus W. van Lieshout teaches of a method and apparatus for continuously filling and dispensing large numbers of cups with beverages, such as beer. This method is a simple down flow manifold system, with problems arising when a pressurized beverage is dispensed and the quantities are not evenly distributed. Any ice put in the glasses for beverages other than beer would need to be put in at another location.

U.S. Pat. No. 4,411,295 of Steven D. Nutter discloses a device for equally filling a plurality of containers. Described is a device for equally filling a plurality of containers, including a primary distributor disc having a top inlet and a plurality of bottom outlets equally spaced from the top inlet, and equally spaced around the primary distributor disc, a plurality of secondary distributor discs, each having a top inlet and a plurality of bottom outlets equally spaced from the secondary distributor disc top inlets and equally around the secondary distributor disc, a plurality of equal fluid conducting pipes, one for connecting each of the outlets of the primary distributor disc to the inlet of one of the secondary distributor discs, and a filler hose connected to each of the outlets of the secondary distributor discs and extending downwardly to one of the containers of the plurality of containers. Along with the requirement of being absolutely level, the only thing harder than reading this last sentence/paragraph would be cleaning this device.

U.S. Pat. No. 5,293,757 of Tomoyuki Nashio describes a highly mechanized ice dispenser with the capability of filling the glass with water. This dispenser retains a great volume of ice pieces requiring some form of refrigeration. Here again is a very involved machine, difficult to clean and maintain, along with the fact that it uses a downward flowing manifold distribution for the water producing an uneven flow to the glasses.

U.S. Pat. No. 3,811,604 of Elmer L. Perry discloses a liquid dispensing device for simultaneous filling of a tray of drinking glasses. Multiple valve stems seat within discharge orifices with the stems urged upwardly to an open position by a cam or solenoid actuated plate. Spring means seats each valve stem downwardly to a closed position. Diversion means divert a trough carried water flow into multiple recessed areas of an equal size for the collection therein of an equal volume of liquid which is subsequently discharged into each glass. This form of transporting a liquid in an open trough beneath working mechanisms would allow that metal particles and debris from natural wear would have the opportunity to fall into the trough area. Troughs are not recommended to transport potable water. This complicated device does not define any method for inserting ice into the glasses.

U.S. Pat. No. 4,972,886 of David T. Bernstein teaches of an ice distribution system comprised of a light weight, hand carried ice distribution tray which functions in conjunction with a plurality of glasses, or other drink receptacles. This tray is comprised of a series of funnels which isolate the glass area so that the liquid or ice entering the glasses only, and not around the outside of the glasses. Although the glasses are filled in this manner, there is no metering ability to control the volume of ice or water, leaving only the standard method of tipping the tray to equalize the level of the glasses.

U.S. Pat. No. 3,732,903 of John E. Oates describes a device for the delivery of liquids into containers. The invention provides a simple device for quickly delivering an equal predetermined volume of a liquid simultaneously into each of a plurality of identical containers. The invention consists of a tray of a predetermined volume with a plurality of orifices to distribute the liquid into the containers. No control in the opening of the orifices means that the liquid entering the tray will go into the closest orifice first, thus not giving an equal volume in each container. Again it is not an acceptable practice to use an open trough or tray to distribute liquids, in that if it is left for a period of time between fillings, the tray will be open to contamination U.S. Pat. No. 2,447,281 of Herman Schnier teaches of another open tray type multiple container filling device, not an acceptable practice for filling beverage as in water glasses.

U.S. Pat. No. 3,393,716 of Zygmunt Olson describes a multiple drink mixer and dispensing device, in which the drink ingredients are each received in a separate compartment, then mixed in one compartment, and finally a multiplicity of mixed drinks are then dispensed simultaneously. This invention does not relate in any way to the filling of water glasses or other like containers with ice and a single liquid.

As such, there is a pressing need in the food service industry to simplify and expedite the tasks involved with large scale beverage preparation required in giving quick service to the customers at restaurants, conventions, and banquets and the like.

SUMMARY OF THE INVENTION

The above problem and others are overcome by the disclosed unique simple processing apparatus of preparing and filling beverage containers. Two devices are used for the rotating, inserting ice, and filling glasses, cups or other like containers, with ice and a beverage. The devices in combination are the current best mode of the accomplishing the operation, however, either used alone would also significantly enhance the process of filling glasses with either ice or a beverage and consequently use of either device separately is anticipated for the enhancement of the preparation of the water glasses with ice at restaurants, banquets, and in the food service industry.

When the glasses come from the dishwasher, they are in a conventionally divided rack with the bottom of the glass up. The glasses in such divided rack are also generally stored and transported while inside the racks. To fill the glasses they must be inverted into another rack before being filled with ice and water to be dispersed to the customers. A first device of the system herein disclosed accomplishes this inversion process with a simple manual inversion using the standard rack of glasses right from storage or the dishwasher. In flipping the glasses, the rack with the bottom sides up is placed in the bottom cavity of the inversion device and an empty conventional rack placed above it. Both racks slide into separate cavities which position both racks in a registered position to each other with glass opening to opening. When the inversion device is rotated slowly, it allows the upside down glasses to slide to the second rack and into the open side up position in the adjacent rack. Slow rotation is the current best mode so the rapid rotation of the inversion device is prevented by a restriction clutch on the rotation shaft or other conventional dampening apparatus which restricts the speed of rotation of the inversion device.

As noted above, the inversion device by itself is a major improvement in the art of manipulation of glassware for filling and could be used by itself to yield a great improvement in efficiency.

In a second step if used in combination with a filling unit herein disclosed, once the glasses are positioned in the second rack from the rotation of the inversion device, that rack of glasses in the open side up position is removed from the inversion device and placed into the frontal opening of the preparation and filling unit. The filling unit consists of a stainless steel box-like structure with side walls and a bottom with a drain for attachment to a sewer or other drain, and a sliding means such as a set of rollers whereby the glass rack, full up upright glasses, is slid to the back of the unit through the frontal opening. This unit may be self-supporting on attached legs or may be made without legs for positioning on an existing table. To one side is pivotally attached a shelf for supporting the third component of the system which is the ice tray adjacent to the side opening that the ice tray slides through. The ice tray is best used as part of the entire system, however it could be used separately to enhance the filling of glasses with ice which are upright in trays. There are tracks at the front and back of the unit for the ice tray to slide across on to a registered positioned over the glasses. On the model with the attached legs this shelf would pivot down for storage when the unit is not in use. The unit has a cover that pivots up for access and down to enclose the internal area. The cover houses the beverage dispensing manifold attached to a flexible source connection, as in a water line when filling water glasses.

The ice tray consists of a stainless steel tray with a plurality of openings which are best shaped conical tapered openings, that center on and register with the openings of the glasses in the rack. Beneath these conical openings is a stainless steel flat slipsheet also having a plurality of openings matching the disclosed tray openings which slide to a closed position with the opening passages in the ice tray closed off by the slipsheet. When the slipsheet is pulled forward to a filling position, the alignment of all the openings register with all the openings in the ice tray to allow the passage of a metered volume of ice to pass into the glass.

In use, the operator will manually spread a thin layer of ice over the ice tray, covering the complete area while the tray is resting on the side shelf. The tray is then manually slid over the preparation and filling unit with the glasses in the rack below with the tray openings registering with the glasses. The slipsheet is then pulled forward to allow the ice in the conical tapered openings to drop into each glass in substantially equal amounts. The ice on the flat surfaces remains on the ice tray and after the slipsheet is repositioned, the ice tray may be jogged back and forth so that the ice on the flats, falls into the conical tapered openings to be put in the next rack of glasses. A similar ice tray may be used with conical tapered openings without the slipsheet that requires the operator to raise the cover of the preparation and filling unit, containing the filling manifold to insert the ice into the glasses through the ice tray openings. After the ice has been inserted into the glasses the tray is removed to the side and the lever on the manifold valve is turned on.

The beverage passes through a simple controlled orifice manifold whereby each glass is filled equally and the manifold may be drained by simply pushing a release button with the remnants diverted to the side, not falling into the glasses. The beverage is kept retained by a valve until released under pressure to fill the manifold, whereupon the small tubular members protruding upwardly from the manifold and then curved down to align with the glasses in the rack below are filled. When the valve is turned off the pressure in the manifold is released and the beverage in the small tubular members is stopped from flowing, filling all the glasses evenly. This is due to the upward curve in the tubular members and liquid seeking the same level. This manifold incorporates quick disconnects so that each segment may be removed for easy cleaning. In some cases the operator may choose a manifold with downward projecting filling orifices releasing the beverage directly in to the glasses. This is an option to the system and can be changed easily with the quick disconnects on the manifolds.

By watching through the opening for the ice tray in the unit, the first row of glasses is visible so that the operator may determine when to turn off the beverage. After filling the rack containing the prepared glasses, the operator may remove the rack for disbursement or the rack may be left in the unit in a covered sanitary environment. This unit may also be constructed whereby the racks enter from the side on a conveyor roller system and the ice tray enters from the front. The glass rack opening of the preparation and filling unit protrudes to the front of the device and the opening is large enough so that in the event the glasses were filled unevenly the glass rack may be tipped to attain an even filling of the glasses.

Accordingly, it is the object of this invention claimed herein to provide a simplified processing system whereby ice and beverage may be prepared in quantity and kept in a sanitary environment.

It is another object of this invention to supply a processing system that is operated manually, requiring no power hook-up.

It is still another object of this invention to supply a processing system that can be quickly disassembled for cleaning and just as easily reassembled.

It is still another object of this invention to supply a processing system occupying a minimum amount of floor space.

It is still another object of this invention to supply a processing system that cannot only be used to prepare and fill a quantity of water glasses, but also any of the other beverages used by snack bars and restaurants.

This procedure accordingly comprises the features of the construction, combination of elements, and arrangement of parts that will be exemplified in the construction hereinafter set forth in the specification, and the scope of the invention will be indicated in the claims

BRIEF DESCRIPTION OF THE DRAWING FIGURES

The accompanying drawings which are incorporated in and form a part of this specification illustrate embodiments of the disclosed processing system and together with the description, serve to explain the principles of the invention.

DETAILED DESCRIPTION OF THE PREFERRED EMBODIMENTS

Figure 1:
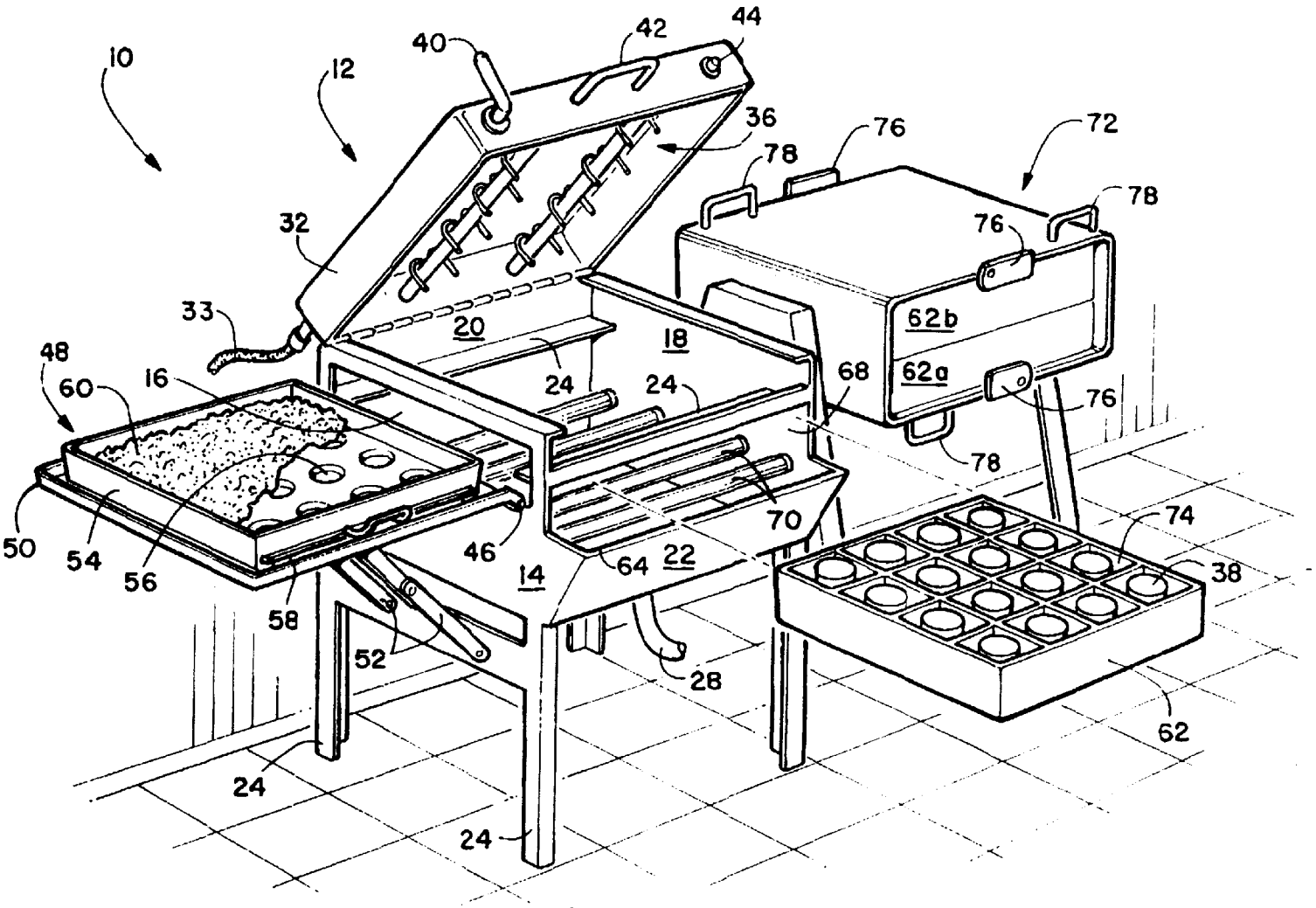
FIG. 1 depicts a perspective view of a free-standing processing system for preparing and filling beverage containers.

Referring now to FIG. 1 depicting a perspective view of the best mode of the free-standing three component processing system 10, providing the individual components best used in combination for preparing and filling beverage containers with ice and liquid. As noted, each component by itself is a considerable improvement in the art and could be used individually to yield a major improvement in glass filling and processing on its own. As such the individual use of the components is also anticipated even through the current best mode of the device would use all three components.

The preparation and filling unit 12 consisting of, looking at the front, the left side 14 with the rectangular opening 16, the right side 18, the back 20 and front surface 22 with the attached rails 24. The bottom 26 of preparation and filling unit 12 has a drain line 28 going to the sewer to discard any spillage and overflow. The preparation and filling unit 12 may be used with the optional depicted legs 30 or mounted on an existing table. The top of the filling unit has a cover 32 pivoting on hinge 34, with the unique manifold 36 system whereby the beverage is dispensed to the glasses below without needlessly over filling the glasses 38. The manifold is connected by a pressurized fluid means such as flexible line 33 to the beverage source, as in but not limited to, a water line to fill water glasses. On the front of cover 32 and most accessible to the operator, are the fill valve handle 40, the handle 42 to raise the cover 32 and the drain and flush valve push button 44. The preparation and filling unit 12 provides a vast improvement in the filling of rack mounted glasses.

Attached to the left side 14 of preparation and filling unit 12, by hinge 46 is the ice tray supporting shelf 50 for the second component ice tray 48 of the system 10. This shelf 50 may be raised for operation and lowered for cleaning and storage by the means of the scissor-action locking braces 52. Ice tray 48 is comprised of the four sidewalls 54 and a planar sheet 55 with a plurality of preferably tapered conical tray apertures 56 for dispensing a metered volume of ice into the glasses, slipsheet 58 will be further described in FIG. 6. After being covered with the ice 60, the ice tray 48 the ice is leveled to the height of the sidewalls 54 by shaking the tray or other means and is manually slid through the rectangular opening 16 and along the pair of rails 24 to be positioned above the water glass containment rack 62 and in registered position over the upright glasses 38 to fill the glasses 38 with a substantially equal amount of ice in each glass 38.

The front surface 22 of preparation and filling unit 12 has a protruding lip 64 to catch any spillage to the front of the unit. The glass containment rack 62 is inserted into unit preparation and filling unit 12 through the opening 68 in front surface 22. A plurality of rollers 70 are positioned between left side 14 and right side 18 in alignment with the bottom of opening 68, to allow that the glass containment rack 62 moves in and out easily.

Also depicted in FIG. 1 is the third component of the system 10, the inversion unit 72, positioned adjacent to the preparation and fill unit. The inversion unit 72, used by itself or with the entire system 10 to yield the best results, provides a major improvement in the processing of glasses 38 which arrive from the dishwasher in a conventional rack 62 in an inverted position as depicted and which need to be turned over in the rack 62 to allow filling of the glasses 38 with a beverage.

The inversion unit 72 is shown with glass containment rack 62*a* inserted and having the water glasses 38 with the bottom side up, and with an empty glass containment rack 62*b* upside down with the glass cavities 74 in registered engagement and opposing those in 62*a*. Spring-loaded pivotal stops 76, at both ends of unit provide a means to retain the racks 62 with dividers to hold glassware within the inversion unit 72 when rotating the inversion unit 72. The handles 78 on both top and bottom of the inversion unit 72, while optional, are provided in the current best mode of the device to allow for ease in manual rotation.

Figure 3:
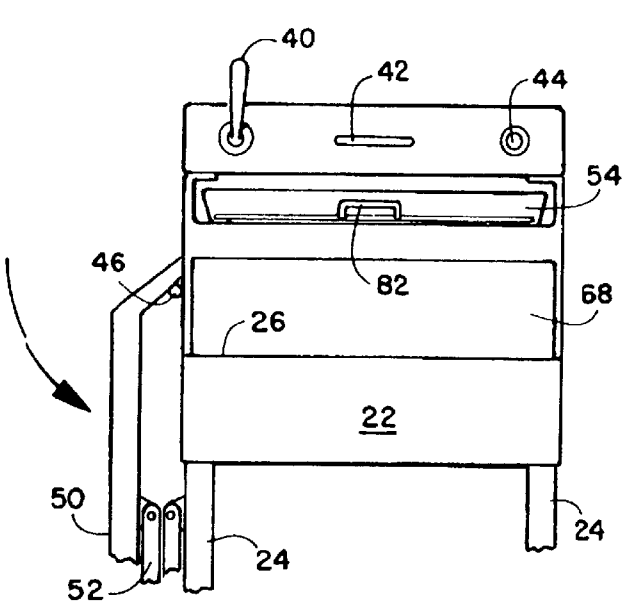
FIG. 3 depicts a frontal view of the preparation unit with the shelf folded to the side for storage and cleaning.
Figure 2:
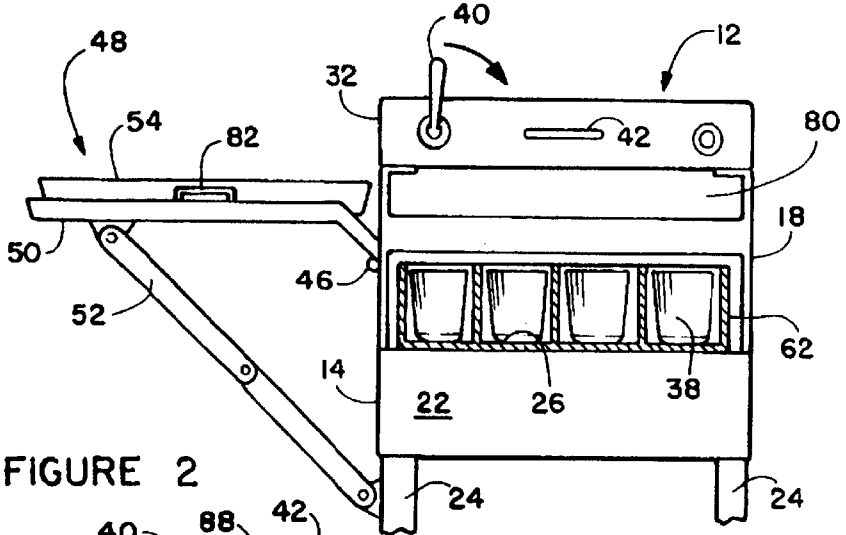
FIG. 2 depicts a frontal view of the preparation unit with the ice tray and shelf in the fixed position. The glass rack is displayed in section, showing the glass location within the unit.

FIG. 2 displays the preparation and filling preparation and filling unit 12 in the frontal view with the shelf 50 extended and retained by the scissor-action locking braces. The opening in the front of the unit illustrates the glass containment rack 62 in section showing the rotated and up-right glasses in the position to be filled. Above opening 62 an additional opening 80 facilitates the observance of the filling of the glasses 38 to an equal and desired level without over-filling. FIG. 3 displays the preparation and filling unit 12 in the frontal view with the shelf 50 retracted in the storage position with the ice tray 48 shown through opening 80, within the unit. In this position handle 82 on slipsheet 58 is accessible to pull and release the metered volume of ice into the glasses.

Figure 5:
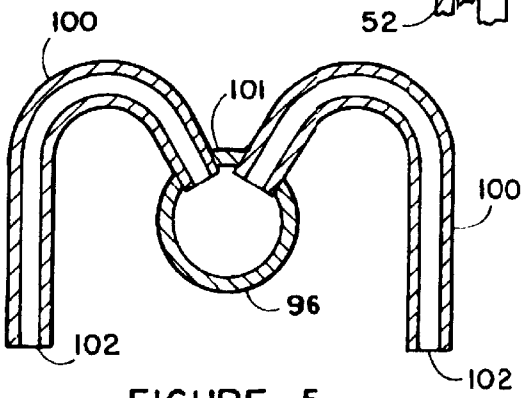
FIG. 5 depicts a section through one of the manifold elements showing the large and small tubular members.
Figure 4:
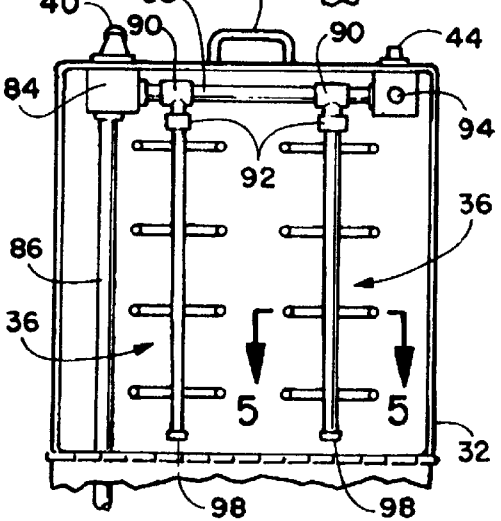
FIG. 4 depicts the underside of the unit cover displaying the valves, quick disconnects and the manifold.

FIG. 4 displays the underside of cover 32 with the unique manifolds 36 in position. At the front of cover is the fill valve handle 40 connected to fill valve 84 that is connected by the fluid pressurized tubular member 86 and flexible line 33 to the beverage source. As depicted in the current best mode with two manifolds 36, both are connected laterally across the front of the under side of the cover 32 by tubular cross member 88 connected to the two unique manifolds 36 by "T" fittings 90 and quick disconnects 92 and further connected to the drain and flush valve 94 activated by push button 44. FIG. 5 further describes the unique features of the manifold 36. The quick disconnect 92 is attached to one end of the large central tubular member 96 and an enclosing cap 98 is attached to the other end and is a means to provide pressurized fluid such as water to the manifolds 36.

A plurality of curved tubular members 100, penetrating the top side 101 of the large tubular member 96 translating upwardly to each side, then curving downwardly so that the orifice 102 is substantially centrally located with one of each over the two adjacent glasses below. A new and unique feature of this manifold 36 is that with the curved tubular members 100 going up out of the top portion 101 of the larger tubular member 96 instead of down out the bottom using gravity as is normal. Consequently, when the pressure of the beverage being dispensed is turned off, the liquid stops at the level of the large tubular member 96, thus stopping the flow at all the orifices 102 at the same time. Any liquid retained in the large tubular member 96 for any appreciable time may be released the means to flush the manifold in this case by pressing the drain and flush push button 44 at the lowest point of the manifold 36.

Figure 6:
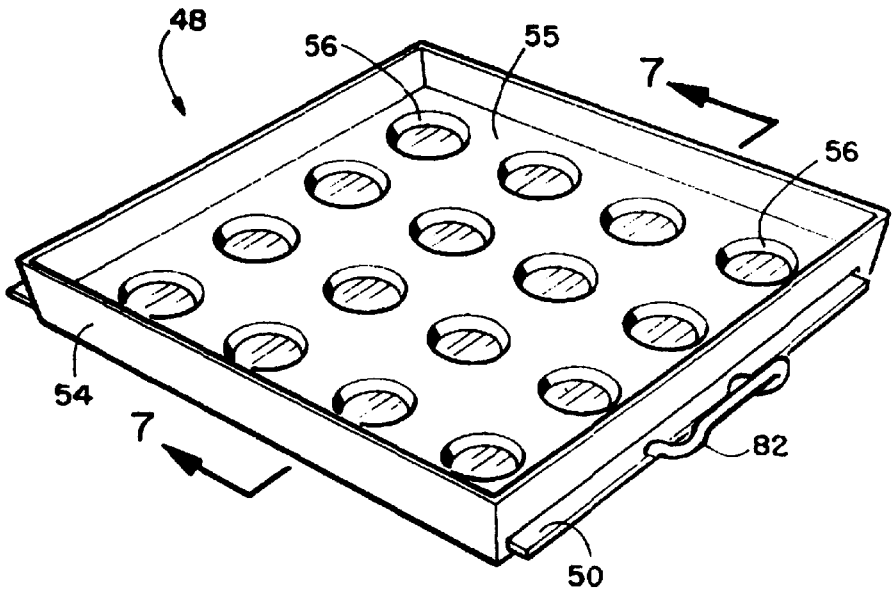
FIG. 6 is a perspective view of the ice tray with the slipsheet.
Figure 7:
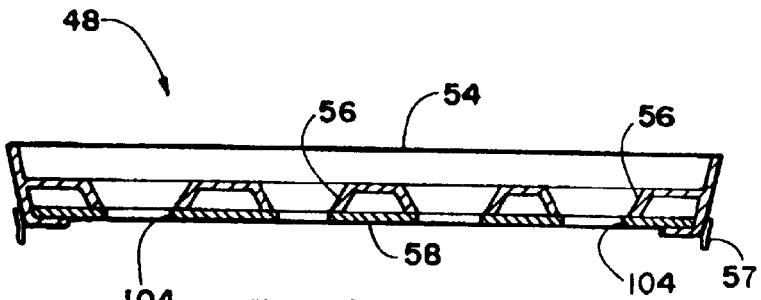
FIG. 7 is a section through the ice tray displaying the alignment of the matching hole pattern.

FIG. 6 depicts the improved the ice tray 48 in a perspective view showing the plurality of tray apertures 56 preferably tapered in shape, for metering the quantity of ice 60 to be dispensed to each glass 38. To meter the amount of ice 60 placed in each glass 38, the ice 60 is placed in a substantially equal layer in the ice tray 48 and then the slipsheet 58 shown in the closed position is slid to an open position with the slipsheet apertures 104 registering with the tray apertures 56 thereby allowing a substantially equal amount of ice to drop into each glass 38 in registered position below. The ice tray 48 is sized to mate to the top of a conventionally configured rack 62 in registered engagement with the glasses below. Optional registration tabs 57 may be provided to allow the ice tray 48 to mate with the top of the rack 62 with the tray apertures 56 registered over the upright glasses 38. FIG. 7 shows a cross section of the ice tray 48 with the conical tapered tray apertures 56 in alignment with the plurality of slipsheet apertures 104 located in the slipsheet 58. Once registered over the glasses 38 the slipsheet 58 is pulled to allow the slipsheet apertures 104 to align and allow gravity to place a metered amount of ice in the glass since the ice is leveled in the tray 48 to the height of the sides 54.

Figure 8:
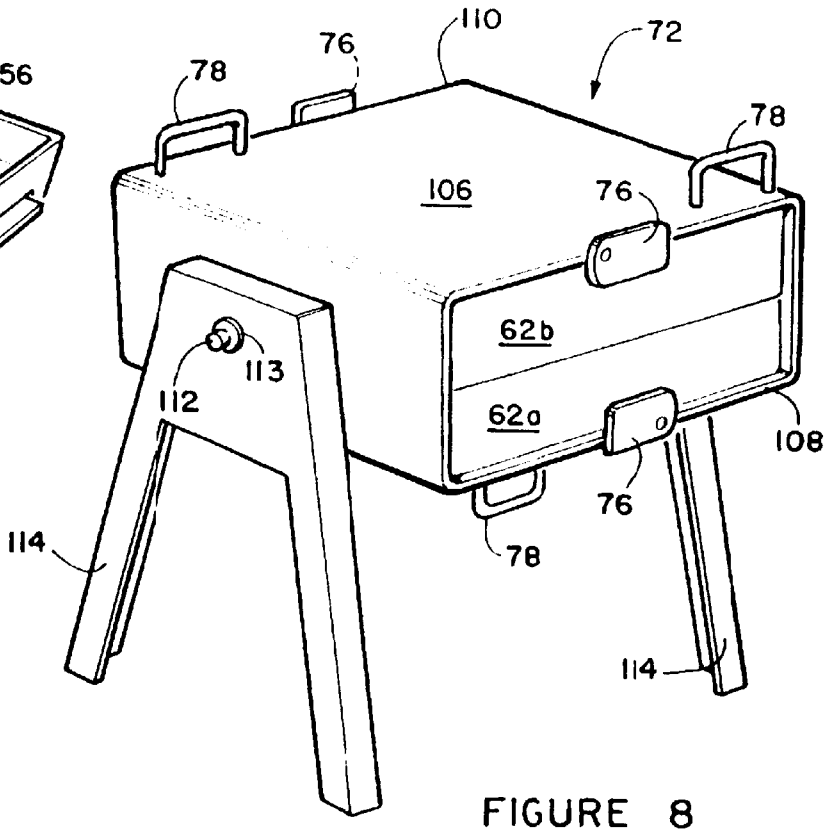
FIG. 8 is a perspective view of the glass rack inversion device.

FIG. 8 is a perspective drawing of the inversion unit 72 which used to turn the glasses 38 over from their original position which is upside down in the rack 62 when they arrive from the dishwasher. The inversion unit 72 as noted is a major improvement in turning glasses 38 over from their inverted position after washing in the rack 62 in a conventional commercial dishwasher and provides a major improvement by itself, or in the best mode in combination with the entire system 10. The inversion unit 72 is best made of stainless steel because of food handling requirements and is a rectangular body 106 with openings at both the front end 108 and rear end 110 communicating therethrough to allow the racks 62 be inserted and removed to and from the cavity therein.

In use, a lower rack 62*a* is inserted as arriving from the dishwasher with the glasses 38, bottom side up. A second upper rack 62*b*, which is essentially an empty version of the lower rack 62*a*, is inserted above lower rack 62*a*, with the glass cavities 74 of both racks registered with and opposing each other. A means to retain the racks 62*a* and 62*b* in the body during rotation is provided by pivotal stops 76 which pivot to an upright position to maintain the racks 62*a* and 62*b* in the rectangular body 106. The pivotal stops 76 also hold the racks 62*a* and 62*b* in position with their respective cavities 74 in a registered or inline position with each other thereby providing a means of registering the cavities 74 of the two racks with each other. Of course other means of registering the cavities 74 of the two rack so that glasses 38 easily slide from one cavity 74 in one rack to the registered cavity 74 in the other might be used by those skilled in the art, and such is anticipated, however the depicted manner is the current best mode. When dealing with racks 62 from different manufacturers or which are not to industry specification, a spacer with cavity guides(not shown) communicating therethrough might be placed between the two racks 62*a* and 62*b* to help align the cavities 74. The inversion unit 72 then easily moves the glasses 38 from their upside down position in rack 62*a* to an upright position in rack 62*b* when the rectangular body 106 is rotated 180 degrees using a means for rotation of the rectangular body 106 such as axils 112 communicating through two leg assemblies 114. Rotating the rectangular body 106 and the racks 62*a* and 62*b*, held therein, causes gravity to slide the upside down glasses in rack 62*a* which starts at the bottom position, into an upright position into empty cavities 74 of the previously upper rack 62*b* which ends up on the bottom. A slow rotation is best as too fast a rotation produces excess friction on the glasses 38 from centrifugal force. Such a slow rotation can be insured by a means of rotation speed restriction such as fictional clutch 113 located on the axil 112 or other conventional dampening apparatus located in the support leg assembly 114. Once a full 180 degree rotation is achieved, the pivotal stop 76 in front of the tray 62*b* now containing the upright glasses would be removed from engagement with the tray and the tray 62*b* removed. The process would continue with a new tray 62 of inverted glasses 38 being inserted and rotated.

While the present process has been described herein, with reference to particular embodiments and components thereof, a latitude of modifications, various changes and substitutions are intended in the foregoing disclosure, and it will be apparent that in some instances some features of the device can and will be employed to improve current water glass filling without a corresponding use of other features without departing from the scope of the process set forth.

What is claimed is:

1. An apparatus for inversion of racked glasses, positioned in a divided glassware rack, comprising:

an inversion unit, said inversion unit having a body engaged with a frame, said body having a front aperture communicating with a rear aperture through a central cavity, said central cavity defined by said sidewall;

said central cavity having a first rack shelf and a second rack shelf positioned axially therein;

means to rotate said body;

said first rack shelf adapted for engagement with a glass rack having a first plurality of glass cavities therein;

said second rack shelf adapted for engagement with a second glass rack having a second plurality of glass cavities therein;

means to register said first plurality of glass cavities to a substantially inline position with said second plurality of glass cavities when said first rack is engaged on said first rack shelf and said second rack is engaged on said second rack shelf, whereby glasses in said first plurality of glass cavities are transferred to said second plurality of cavities in an upright position when said inversion unit is rotated.

2. The apparatus for inversion of racked glasses as defined in claim 1 additionally comprising:

means to retain said first glass rack and said second glass rack in a substantially fixed position in said central cavity when said body is rotated.

3. The apparatus for inversion of racked glasses as defined in claim 1 wherein said means to rotate said inversion unit comprises:

axles positioned on exterior sides of said body; and said axles rotationally engaged with said frame.

4. The apparatus for inversion of racked glasses as defined in claim 2 wherein said means to rotate said inversion unit comprises:

axles positioned on exterior sides of said body; and said axles rotationally engaged with said frame.

5. The apparatus for inversion of racked glasses as defined in claim 1 further comprising a means of rotation speed restriction of said body.

6. The apparatus for inversion of racked glasses as defined in claim 2 further comprising a means of rotation speed restriction of said body.

7. The apparatus for inversion of racked glasses as defined in claim 3 further comprising a means of rotation speed restriction of said body.

8. The apparatus for inversion of racked glasses as defined in claim 4 further comprising a means of rotation speed restriction of said body.

9. The apparatus for inversion of racked glasses as defined in claim 2 wherein said means to retain said first glass rack and said second glass rack in said central cavity when said body is rotated comprise a first pair of pivotable stops located at said front aperture and a second pair of pivotable stops located at said rear aperture.

10. The apparatus for inversion of racked glasses as defined in claim 3 wherein said means to retain said first glass rack and said second glass rack in said central cavity when said body is rotated comprise a first pair of pivotable stops located at said front aperture and a second pair of pivotable stops located at said rear aperture.

11. The apparatus for inversion of racked glasses as defined in claim 5 wherein said means to retain said first glass rack and said second glass rack in said central cavity when said body is rotated comprise a first pair of pivotable stops located at said front aperture and a second pair of pivotable stops located at said rear aperture.

* * * * *